US005934119A

United States Patent [19]

Keller

[11] Patent Number: 5,934,119

[45] Date of Patent: Aug. 10, 1999

[54] SPRING-LOADED RETAINER IN A TWIST LOCK BARREL FOR A SAFETY LOCK

[76] Inventor: Ernst Keller, Untere Schwandenstrasse 22, CH-8805 Richterswil, Switzerland

[21] Appl. No.: 09/011,035

[22] PCT Filed: Aug. 2, 1996

[86] PCT No.: PCT/CH96/00271

§ 371 Date: Feb. 6, 1998

§ 102(e) Date: Feb. 6, 1998

[87] PCT Pub. No.: WO97/07310

PCT Pub. Date: Feb. 27, 1997

[30] Foreign Application Priority Data

Aug. 11, 1995 [CH] Switzerland ..... 2314/95

[51] Int. Cl.[6] ..... E05B 47/00

[52] U.S. Cl. ..... 70/276; 70/358

[58] Field of Search ..... 70/276, 413, 419, 70/358, 359, 378, 492, 493

[56] References Cited

U.S. PATENT DOCUMENTS

| | | | |
|---|---|---|---|
| 3,494,157 | 2/1970 | Coker, Jr. | 70/276 |
| 3,656,328 | 4/1972 | Hughes | 70/276 |
| 3,869,889 | 3/1975 | Prahl | 70/419 |
| 4,026,134 | 5/1977 | Woolfson | 70/276 |
| 4,380,162 | 4/1983 | Woolfson | 70/276 |
| 4,856,309 | 8/1989 | Eizen | 70/359 |
| 5,074,136 | 12/1991 | Kim et al. | 70/276 |
| 5,123,268 | 6/1992 | Eizen | 70/359 |
| 5,437,176 | 8/1995 | Keller | 70/358 |
| 5,457,974 | 10/1995 | Keller | 70/359 X |

FOREIGN PATENT DOCUMENTS

| | | | |
|---|---|---|---|
| 313864 | 5/1989 | European Pat. Off. | 70/358 |
| 0 396 492 | 11/1990 | European Pat. Off. . | |
| 472495 | 2/1992 | European Pat. Off. | 70/358 |
| 669 633 | 3/1989 | Switzerland . | |
| 671428 | 8/1989 | Switzerland | 70/358 |
| 2 066 347 | 7/1981 | United Kingdom . | |
| WO 91/05931 | 5/1991 | WIPO . | |

*Primary Examiner*—Suzanne Dino Barrett
*Attorney, Agent, or Firm*—Browdy and Neimark

[57] ABSTRACT

A safety lock comprises a spring-loaded tumbler (4) which is arranged in a twistlock cylinder (1) and which is provided with a rotor pin (12) and a housing pin (2) which are arranged in order, for the rotational release of the rotor (3), by means of an insertable key introduced into a keyway (22) of the twistlock cylinder (1). A blocking member (5), which follows the housing pin (9) in the event of an attempt to unlock the lock, has a part (11) which is guided displaceably in the housing pin (9) and which is connected magnetically to the rotor pin (12).

7 Claims, 1 Drawing Sheet

SPRING-LOADED RETAINER IN A TWIST LOCK BARREL FOR A SAFETY LOCK

BACKGROUND OF THE INVENTION

1. Technical Field of the Invention

The invention relates to a spring-loaded tumbler in a twistlock cylinder for a safety lock, with a rotor pin and a housing pin which are arranged in order, for the rotational release of the rotor, by means of an insertable key introduced into a keyway of the twistlock cylinder, and with a blocking member which follows the housing pin in the event of an attempt to unlock the lock.

2. Prior Art

A tumbler of this type became known from CH-A-669, 633 of the Applicant. This possesses a blocking pin and compression spring in a bore of the plug pin. The compression spring presses with prestress onto the blocking pin which itself presses onto the housing pin bearing on the plug pin. When the housing pin is lifted off from the plug pin in the event of an attempt to unlock the lock, the blocking pin follows the housing pin essentially without delay and locks the rotor.

Increasingly more efficient instruments are available for unauthorized unlocking methods which primarily employ the Hubb procedure. There is therefore an urgent need for further tumblers which take into account the further development of such break-in tools.

OBJECT AND SUMMARY OF THE INVENTION

The object on which the invention is based is to provide a tumbler of the type mentioned, the unlocking security of which allows for the more stringent safety requirements. Unlocking security is used to mean the degree of difficulty in arranging the tumblers of a lock cylinder in order non-destructively, using aids, without a knowledge of the lock code.

In a conventional tumbler, the object is achieved in that the blocking member has a part which is preferably guided displaceably in the housing pin and which is connected magnetically to the rotor pin. During the authorized arrangement of the tumbler in order by means of an associated insertable key, the magnetic connection between the displaceably guided part and the rotor pin can be separated, essentially without any additional effort, when the rotor is rotated. By contrast, in the event of an unauthorized attempt to unlock the lock, the displaceably guided part always remains connected to the plug pin. The displaceably guided part therefore always follows the plug pin without delay.

According to a development of the invention, the part guided displaceably is a pin which is mounted in a longitudinal bore of the housing pin. The pin is preferably a steel bolt which is mounted in the housing pin so as to be freely displaceable and which blocks in the event of an attempt to unlock the lock and would have to be sheared off. According to a development of the invention, the rotor pin has a spring element which is supported indirectly or directly on the housing pin and which loads the rotor pin radially inwards. This spring element permanently presses the rotor pin radially inwards. In the event of an attempt to unlock the lock, during which the housing pin is moved radially outwards, the radially guided part of the blocking member is always held, by being fixed magnetically, in a position in which this displaceably guided part oversteps the shearing line of the rotor and consequently blocks it. It would therefore be possible to release the rotor only when the housing pin and, at the same time, the rotor pin are arranged in order.

A particularly strong magnetic connection can be made when the blocking member has a permanent magnet made from an alloy which contains metals from the lanthanide group. It is consequently possible to exert a high force of adhesion even with a very small magnetic part. The permanently magnetic part may therefore be produced as a pin with a diameter of, for example, 0.5 mm.

BRIEF DESCRIPTION OF THE DRAWINGS

An exemplary embodiment of the invention is explained in more detail below with reference to the drawing in which.

DETAILED DESCRIPTION OF THE DRAWINGS

Figure 2:
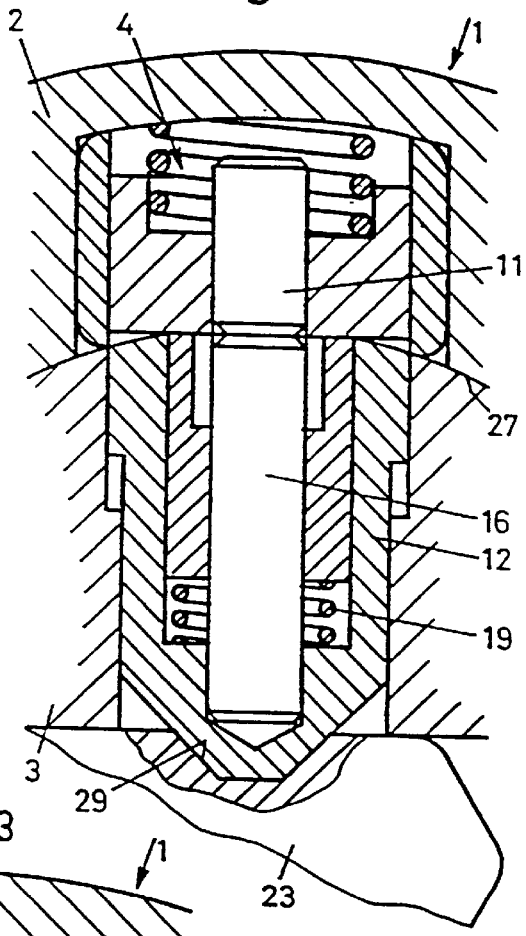
FIG. 2 shows a section according to FIG. 1, but with an insertable key introduced into the keyway.

A twistlock cylinder 1 conventional per se, only a portion of which is shown, has a housing 2 with a longitudinal bore 27, in which a rotor 3 is mounted. Worked into the rotor 3 is a keyway 22, into which a key 23 is to be introduced in order to arrange a tumbler 4 in order. In this case, by means of a bore 29 in the key 23, the tumbler 4 is moved radially outwards in a radial bore 24, counter to the reacting force of a housing spring 8, and is arranged in order. FIG. 2 shows the tumbler 4 arranged in order. Here, the rotor 3 is not blocked by the tumbler 4 and can be rotated by means of the key 23, and a lock bolt, not shown here, can be actuated. The lock cylinder 1 has, as a rule, a plurality of such tumblers 4.

In the version shown, the housing pin 9 is mounted in a bore 7 of a slide 6 known per se. A steel pin 11 is guided displaceably in a continuous longitudinal bore 10 of the housing pin 9. This pin 11 adheres magnetically to a pin 16 which is inserted into a blind bore 14 of a rotor pin 12 and which is pressed into a bore 20. The pin 16 is thus anchored firmly in the rotor pin 12. The pin 16 is a permanent magnet and is preferably produced from an alloy made from rare-earth metals (lanthanides). The permanent magnet possesses, at its free end, a plane end face 30, against which a likewise plane face 31 of the pin 11 bears. When the tumbler 4 is arranged in order, the faces 30 and 31 lie in the shear plane 27 of the lock cylinder 1. Thus, when the rotor 3 is rotated, with the tumbler 4 arranged in order, it is possible for the pins 11 and 16 to be displaced radially in relation to one another.

Figure 1:
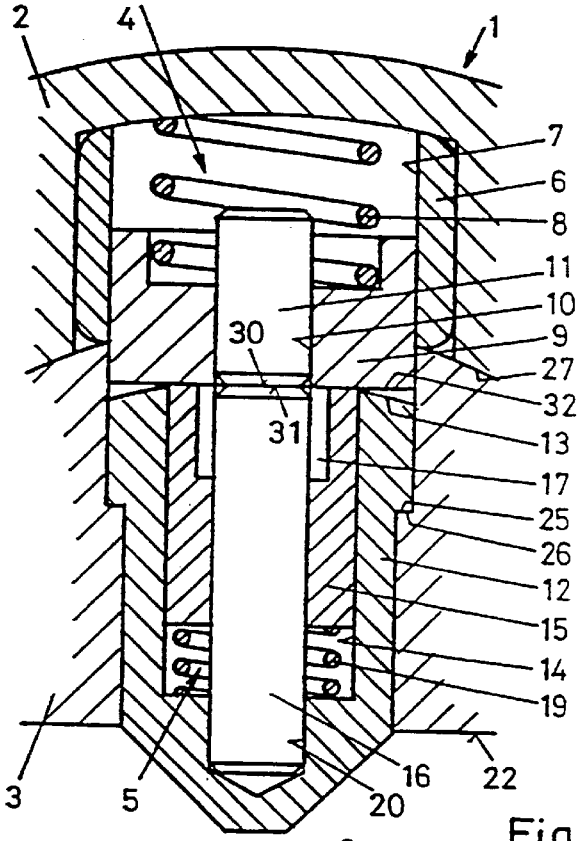
FIG. 1 shows a section through part of a lock cylinder with a tumbler according to the invention, in the basic position.

The housing pin 9 bears with the front face 32 against a face 13 of the pin 12 and holds the latter in the position shown in FIG. 1, in which the pin 12 bears with its shoulder against a shoulder 25 of the bore 24. Mounted in the blind bore 14 is a sleeve 15 which receives the pin 16 by means of a continuous stepped bore 17. The bore 14 receives a compression spring 19 which tensions the sleeve 15 against the housing pin 9. The spring 19 has a spring force which is substantially lower than that of the spring 8. The significance of the spring 19 is explained further below.

The operating mode of the tumbler 4 is explained in more detail below with reference to the drawing.

During the authorized arrangement of the tumbler 4 in order by means of a key 23, the pins 11 and 16 are arranged, according to FIG. 2, in such a way that they can be displaced laterally in relation to one another when the rotor 3 is rotated. The tumbler 4 thus works here in the same way as a conventional tumbler without a blocking member.

Figure 3:
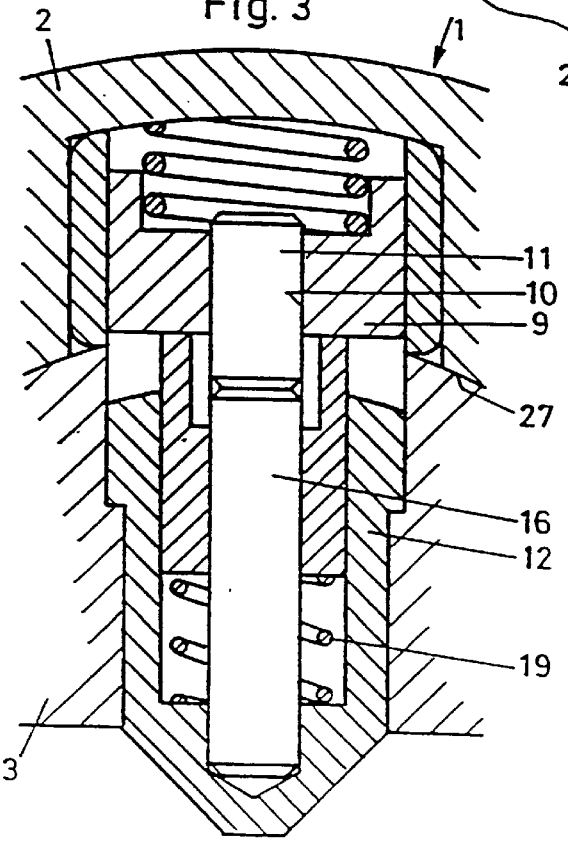
FIG. 3 shows an illustration according to FIG. 1, the tumbler being shown here in a state during an attempt to unlock the lock.

Now if, according to FIG. 3, the housing pin 9 is moved outwards into the housing 2 in the event of an attempt to unlock the lock, the pin 11 remains adhering to the permanently magnetic pin 16 and remains in the blocking position shown in FIG. 3. As is evident, the pin 11 oversteps the shear plane 27 and would have to be sheared through with a rotational release of the rotor 3. Since the pin 11 is freely displaceable in the bore 10, it also cannot be fixed in the housing pin 9 by tilting the rotor. For the rotational release of the lock cylinder, therefore, the rotor pin 12 would also have to be lifted into the position shown in FIG. 2, this being scarcely possible, and at the same time, moreover, the reacting force of the spring 19 would have to be overcome.

A version in which the pin 11 is designed as a permanent magnet is also conceivable. The housing pin 9 would then have to be produced from a non-magnetic material. Finally, it is also conceivable to have a version in which the pin 11 is connected fixedly to the housing pin 9 and the pin 16 is mounted so as to be freely displaceable in the rotor pin 12. An appreciable improvement in lock security is afforded even when the lock cylinder 1 has at least one tumbler 4 according to the invention. Some tumblers of the lock cylinder 1 may therefore be designed conventionally.

I claim:

1. Spring-loaded tumbler in a twistlock cylinder (1) for a safety lock with a rotor pin (12) and a housing pin (9) which are coaxially engaged, for the rotational release of a rotor (3), by means of an insertable key (23) introduced into a keyway (22) of the twistlock cylinder (1), and with a blocking member (5) which, in the event of an attempt to unlock the lock, during which the housing pin (9) is lifted off from the rotor pin (12), follows the housing pin (9) and engages into an interspace between the housing pin (9) and the rotor pin (12), in order to lock the rotor (3) instead of the housing pin (9) and the rotor pin (12), wherein the blocking member (5) has a part (11) which is guided displaceably in the housing pin (9) and which is connected magnetically to the rotor pin (12).

2. Tumbler according to claim 1, wherein the part (11) guided displaceably in the housing pin is a pin which is mounted so as to be freely displaceable in a longitudinal bore (10) of the housing pin (9).

3. Tumbler according to claim 1, wherein the blocking member (5) has a part (16) which is connected fixedly to the rotor pin (12) and which, on a rear side of the rotor pin (12), is connected magnetically by bearing faces (30, 31) to the part (11) guided displaceably in the housing pin (9).

4. Tumbler according to claim 1, wherein the rotor pin (12) has a spring element (19) which is supported indirectly or directly on the housing pin (9) and which loads the rotor pin (12) radially inwards.

5. Tumbler according to claim 4, wherein the spring element (19) is supported on the housing pin (9) by means of a sleeve (15).

6. Tumbler according to claim 5, wherein the sleeve (15) is mounted displaceably in a longitudinal bore (14) of the rotor pin (12).

7. Tumbler according to claim 1, wherein the blocking member (12) has a permanently magnetic part (16) which is connected fixedly to the rotor pin (12).

* * * * *